US006422980B1

(12) United States Patent
Simonson

(10) Patent No.: US 6,422,980 B1
(45) Date of Patent: Jul. 23, 2002

(54) STANDING ABDOMINAL EXERCISE APPARATUS

(76) Inventor: Roy Simonson, 727 Bear Paw La., Colorado Springs, CO (US) 80906

( * ) Notice: Subject to any disclaimer, the term of this patent is extended or adjusted under 35 U.S.C. 154(b) by 0 days.

(21) Appl. No.: 09/437,317

(22) Filed: Nov. 10, 1999

Related U.S. Application Data

(63) Continuation-in-part of application No. 09/379,307, filed on Aug. 23, 1999.

(51) Int. Cl.[7] ..... A61B 21/06
(52) U.S. Cl. ..... 482/99; 482/102; 482/142
(58) Field of Search ..... 482/99, 102, 103, 482/142

(56) References Cited

U.S. PATENT DOCUMENTS 4,474,370 A * 10/1984 Oman ..... 482/142
4,635,926 A * 1/1987 Minkow ..... 482/102
5,362,290 A * 11/1994 Huang ..... 482/102

OTHER PUBLICATIONS

Narragansett Machine C. *Catalog or Gym—Nastic Apparatus* p 23, 1925.*

* cited by examiner

*Primary Examiner*—John Mulcahy
(74) *Attorney, Agent, or Firm*—Workman Nydegger & Seeley

(57) ABSTRACT

An exercise apparatus is disclosed including a base structure having a central support member with a first end and a second end to which a vertically oriented resistance assembly is secured. The apparatus also includes a cable having a first strand and a second strand. The cable links a user to the resistance assembly for the application of resistance as the user moves through an exercise routine. The first and second strands exit the resistance assembly at a position adjacent an upper end of the resistance assembly for engagement by the user at a position above the shoulders of the user. The apparatus further includes a user support structure having an upwardly extending support post. The support post includes a first end secured to the central support member and a second end. The support post further includes a rearward side facing away from the weight stack upon which is mounted a user support pad shaped and dimensioned for supporting a user's back as the user stands facing away from the resistance during an exercise routine. A family of exercise apparatuses is also disclosed.

10 Claims, 3 Drawing Sheets

STANDING ABDOMINAL EXERCISE APPARATUS

RELATED APPLICATION INFORMATION

This application is a continuation-in-part of U.S. patent application Ser. No. 09/379,307, filed Aug. 23, 1999, entitled "Exercise Apparatus", which is currently pending.

BACKGROUND OF THE INVENTION

1. Field of the Invention

The invention relates to an exercise apparatuses. More particularly, the invention relates to an abdominal exercise apparatus. The abdominal exercise apparatus in accordance with the present invention is built upon a base structure substantially identical to that disclosed in the parent application referenced above.

2. Description of the Prior Art

As with most major muscle groups, a wide variety of exercise apparatuses have been developed to specifically exercise the abdominal muscles of a user. The apparatuses generally require that the exerciser adjust a rather cumbersome user support and/or user interface member, sit upon the user support, secure any belts associated with the user support and engage the user interface member, before proceeding with a desired exercise routine.

A continuing need, therefore, exists for improved abdominal exercise apparatuses. Such apparatuses should be designed to make the exercise process simpler, safer and more accessible to a wide range of exercisers. The present invention provides such an abdominal exercise apparatus.

In addition, and as discussed in the parent application referenced above, a need exists for a full line of exercise apparatus built from the same base structure so as to improve the design and fabrication process, resulting in better more affordable exercise equipment. The present abdominal exercise apparatus adds to the family of exercise apparatuses disclosed and discussed in the parent application referenced above.

SUMMARY OF THE INVENTION

It is, therefore, an object of the present invention to provide an exercise apparatus including a base structure having a central support member with a first end and a second end to which a vertically oriented resistance assembly is secured. The apparatus also includes a cable having a first strand and a second strand. The cable links a user to the resistance assembly for the application of resistance as the user moves through an exercise routine. The first and second strands exit the resistance assembly at a position adjacent an upper end of the resistance assembly for engagement by the user at a position above the shoulders of the user. The apparatus further includes a user support structure having an upwardly extending support post. The support post includes a first end secured to the central support member and a second end. The support post further includes a rearward side facing away from the weight stack upon which is mounted a user support pad shaped and dimensioned for supporting a user's back as the user stands facing away from the resistance during an exercise routine.

It is also an object of the present invention to provide an exercise apparatus wherein the resistance assembly is a vertically oriented weight stack including a plurality of weight plates coupled to the cable for applying resistance as a user moves through an exercise routine.

It is another object of the present invention to provide an exercise apparatus wherein a first pivotally mounted pulley guides the first strand as it exits the resistance assembly and a second pivotally mounted pulley guides the second strand as it exits the weight stack.

It is a further object of the present invention to provide an exercise apparatus wherein the resistance assembly includes a housing having a front face, a rear face, a left side and a right side, and the first and second strands respectively exit the resistance assembly from the left and right sides of the resistance assembly before being directed to a user facing away from the rear face of the resistance assembly.

It is also an object of the present invention to provide an exercise apparatus wherein the user support pad includes a vertically adjustable lumber support pad.

It is still another object of the present invention to provide an exercise apparatus wherein the support post includes a central section which is angled toward the resistance assembly.

It is yet a further object of the present invention to provide an exercise apparatus wherein the central section of the support post is oriented at an angle of approximately 10°.

It is also an object of the present invention to provide an exercise apparatus wherein the second end of the support post is secured to the resistance assembly.

It is also an object of the present invention to provide a family of exercise apparatuses designed to target a variety of muscle groups. The family includes a variety of distinct exercise apparatuses utilizing a substantially identical base structure. The base structure comprises a central support member having a first end to which a user support structure is secured and a second end to which a weight stack is secured. The weight stack is actuated by a cable secured thereto for movement by an individual using a distinct exercise apparatus. Each distinct exercise apparatus further includes first and second lateral support sleeves secured to the base structure for directing opposite strands of the cable to a predetermined position for engagement by a user, wherein at least one distinct exercise apparatus includes first and second support sleeves positioned adjacent an upper end of the weight stack for exercising the abdominal muscles of an individual.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
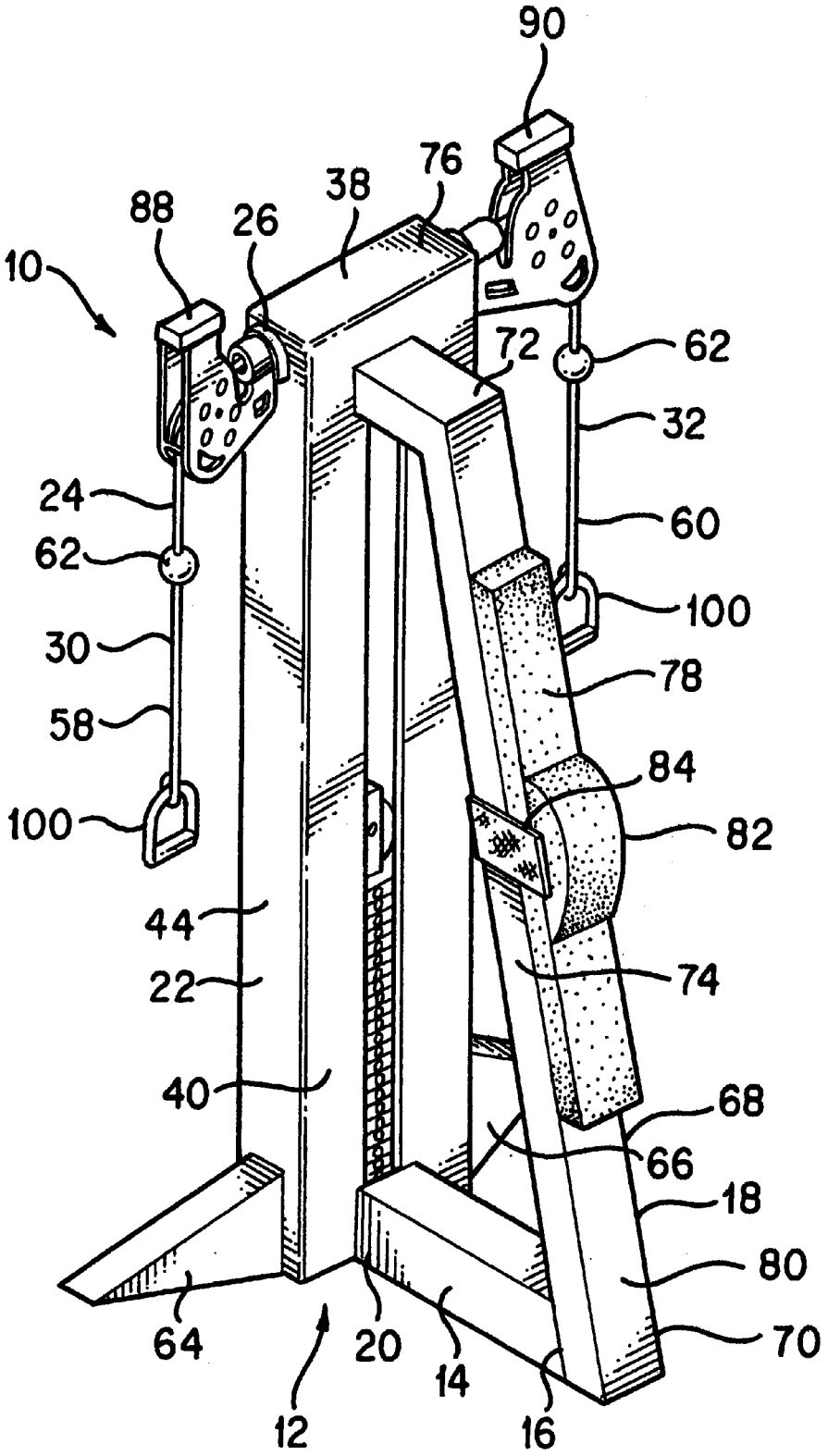
FIG. 1 is a perspective view of the present exercise apparatus.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 to 4, an abdominal exercise apparatus 10 is disclosed. As discussed above in the "Field of the Invention", the present abdominal exercise apparatus includes a base structure 12 substantially identical to the one disclosed in commonly owned U.S. patent application Ser. No. 09/379,307 which is incorporated herein by reference.

With this in mind, the abdominal exercise apparatus 10 includes a base structure 12 having a central support member 14 with a first end 16 to which a user support structure 18 is secured and a second end 20 to which a weight stack 22 is secured. A single cable 24 actuates the weight stack 22. The single cable 24 is secured to the weight stack 22 for movement by an individual using the abdominal exercise apparatus 10. The abdominal exercise apparatus 10 further includes first and second support sleeves 26, 28 selectively secured to the base structure 12 for directing first and second strands 30, 32 (i.e., opposite strands) of the cable 24 to a predetermined position for engagement by a user.

The central support member 14 is preferably a tubular member with a rectangular cross section. As with all of the structural components used in the manufacture of the abdominal exercise apparatus 10, as well as the structural components used in the manufacture of the family of exercise apparatuses, the central support member 14 is formed from steel, although those skilled in the art will appreciate the other materials which may be used in the construction of the disclosed exercise apparatuses without departing from the spirit of the present invention.

The weight stack 22 secured to the second end 20 of the central support member 14 is a conventional, vertically oriented weight stack. The weight stack 22 includes vertical support members 34 aligned to support a stack of weight plates 36 to be moved via a pulley system which will be discussed below in greater detail. The weight stack 24 is covered by a protective sleeve 38 positioned about the weight stack 22. The weight stack 22 is vertically oriented and includes a front face 40, a rear face 42, a left side 44 and a right side 46.

As will be discussed below in substantially greater detail, the weight stack 22 is actuated by a single cable 24 which controls the movement of the weight plates 36. The central portion 48 of the cable 24 is passed through a first pulley 50. A coupling member 52 directly couples the stack of weight plates 36 to the first pulley 50 in a conventional manner. Opposite strands 30, 32 of the cable 24 then respectively extend over first and second upper pulleys 54, 56 before exiting the weight stack 22 from the left and right sides 44, 46 thereof before being directed for engagement by the user.

The respective ends 58, 60 of the first and second strands 30, 32 are each provided with stop members 62. As those skilled in the art will readily appreciate, the stop members 62 control motion of the single cable 24 to allow exercise by pulling the first strand 30 alone, the second strand 32 alone, or both strands at the same time.

First and second lateral support members 64, 66 are also secured to the second end 20 of the central support member 14. The lateral support members 64, 66 extend outwardly from the longitudinal axis of the central support member 14 and away from the first end 16 of the central support member 14. The combination of the cental support member 14, the first lateral support 64 and the second lateral support 66 create a tripod foundation structure. This foundation structure supports the remaining components of the abdominal exercise apparatus 10, as well as users of the present exercise apparatus.

With the versatile base structure 12 disclosed above, the present abdominal exercise apparatus 10, as well as the various exercise apparatuses discussed in the parent application, are created by selectively mounting desired support sleeves at various locations along the base structure. The various exercise apparatuses are created from a single base structure by orienting support sleeves for access along general motion lines.

The provision of a base structure 12 which may be readily used in the manufacture of distinct exercise apparatuses facilitates a novel method for the manufacture of exercise apparatuses. Specifically, a family of exercise apparatuses designed to target a variety of muscle groups is manufactured by first creating a base structure dimensioned for use in the development of a variety of distinct exercise apparatuses designed to target different muscle groups. For example, the base structure is used in the construction of exercise apparatuses including, but not limited to, those focusing on the chest, abdominals, biceps, triceps, lats and shoulders. The base structure includes a central support member having a first end to which a user support structure is secured and a second end to which a weight stack is secured, wherein the weight stack is actuated by a single cable secured thereto for movement by an individual using a distinct exercise apparatus. First and second lateral support sleeves are then secured to the base structure at distinct positions. The first and second support sleeves direct opposite strands of the cable to predetermined positions for engagement by a user to perform various exercises targeting different muscle groups.

The user support structure 18 of the present abdominal exercise apparatus 10 includes an upwardly extending support post 68. The support post 68 includes a first end 70, a second end 72, and a central section 74 oriented for supporting an individual facing away from the weight stack 10 in a manner discussed below in greater detail. The first end 70 of the support post 68 is secured to the first end 16 of the central support member 14 and the second end 72 of the upwardly extending support post 68 is secured to the upper end 76 of the weight stack 22. The central section 74 of the support post 68 is angled toward the weight stack 22 at an angle of approximately 10°. While the disclosed angular orientation of the central section 74 of the support post 68 is considered to promote user comfort, the support post 68 may be oriented at various other angles without departing from the spirit of the present invention.

A support pad 78 is attached to the rearwardly facing side 80 of the upwardly extending support post 68 at the central section 74 thereof to provide added user comfort. As such, and as will be discussed in greater detail below, the user places his or her back upon the support pad 78 while he or she faces rearwardly to perform abdominal exercises.

Added user comfort is provided by the inclusion of an adjustable lumbar support member 82 which is secured about the support pad 78 to provide the user with proper back support as he or she works through an exercise routine. The lumbar support member 82 includes an arched pad with a first and second attachment bands 84 extending from opposite ends thereof. The attachment bands 84 are substantially rigid members shaped and dimensioned to wrap around the upwardly extending support post 68 and support the lumbar support member 82 on the support pad 78. However, the attachment bands 84, 86 are wrapped about the upwardly extending support post 68 such that the lumbar support member 82 may be selectively moved up and down the support pad 78 to suit users of different sizes.

As briefly discussed, the strands 30, 32 of the cable exit the first and second upper pulleys 54, 56 and move directly for use by exerciser. Specifically, the strands 30, 32 move through first and second support sleeves 26, 28 secured at the upper end 62 of the weight stack 22 before engaging the pivoting pulleys 88, 90. The first and second support sleeves 26, 28 extend outwardly from the upper end 62 of the weight stack 22 such that the distal end 92, 94 of each of the first and second support sleeves 26, 28 terminates at a position approximately aligning the strands 30, 32 with the shoulders of an individual utilizing the present abdominal exercise apparatus 10. Given that the support sleeves 26, 28 are secured adjacent the upper end 76 of the weight stack 22, the distal end 92, 94 of each of the first and second support sleeves 26, 28 will be slightly above the shoulders, and probably head, of an individual utilizing the present exercise apparatus.

Specifically, and in accordance with the preferred embodiment of the present invention, the first and second support sleeves 26, 28 extend outwardly perpendicular to the longitudinal axis of the weight stack 22 and within the horizontal plane in which the weight stack 22 sits. The first and second support sleeves extend outwardly at a distance. The center of the pulley is 5 inches from the vertical tower.

First and second pivoting pulleys 96, 98 are respectively coupled to the distal ends 92, 94 of the first and second support sleeves 26, 28. In this way, the strands 30, 32 of the cable 24 respectively exit the first and second support sleeves 26, 28, pass over the pivoting pulleys 96, 98 and are ready for engagement by the user. The distal ends 58, 60 of each strand of the cable 24 may be fitted with a wide variety of grips 100 known to those skilled in the art.

Figure 4:
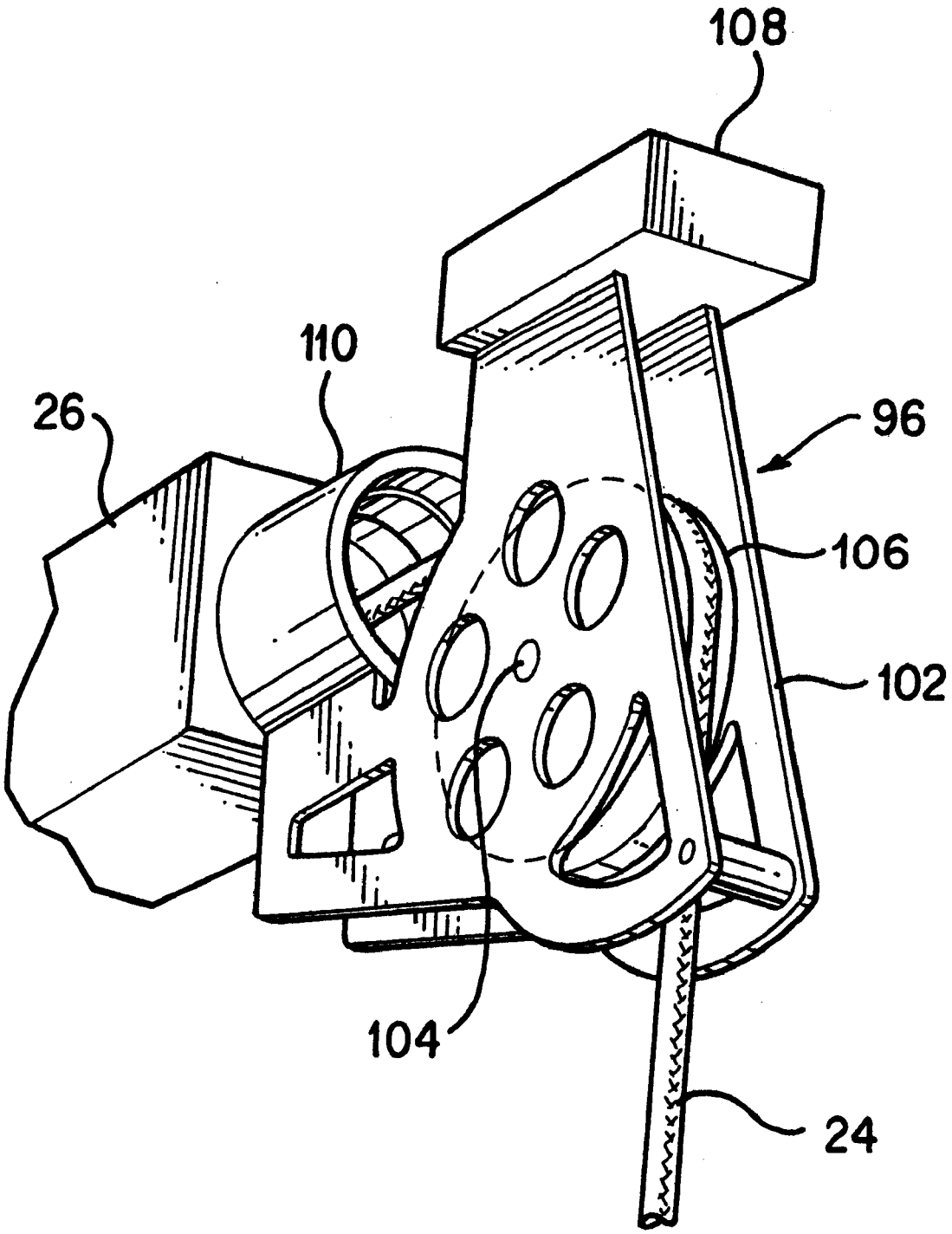
FIG. 4 is a perspective view of the pivoting pulley.

A pivoting pulley 96 is shown in greater detail in FIG. 4. Each pivoting pulley 96 includes a frame 102 with a central pivot 104 for rotatably supporting a pulley member 106. The frame 102 is formed so as to cover the pulley member 106 and thereby prevent undesired access with the pulley member 106 as the cable 24 passes thereover. The frame 102 is further provided with a counterweight 108 opposite the pulley member 106.

The frame 102 further includes a cylindrical coupling member 110 shaped and dimensioned for pivotal attachment to the distal end 92, 94 of a support sleeve 26, 28. The cylindrical coupling member 110 provides an opening through which the cable 24 passes as it extends from the support sleeve 26, 28 toward the pulley member 106. In this way, the cable 24 passes along the axis about which the pivoting pulley 96 pivots relative to the support sleeve 26, 28 to provide greater freedom of motion as an individual attempts to draw the cable in various directions during exercise.

Since the pivoting pulley 96 permits a great degree of flexibility with regard to the angle at which the cable 24 is drawn from the support sleeve 26, 28, the inclusion of the present pivoting pulleys 96 at the distal end 92, 94 of each support sleeve 26, 28 greatly increases the flexibility of the present exercise apparatus 10.

Figure 3:
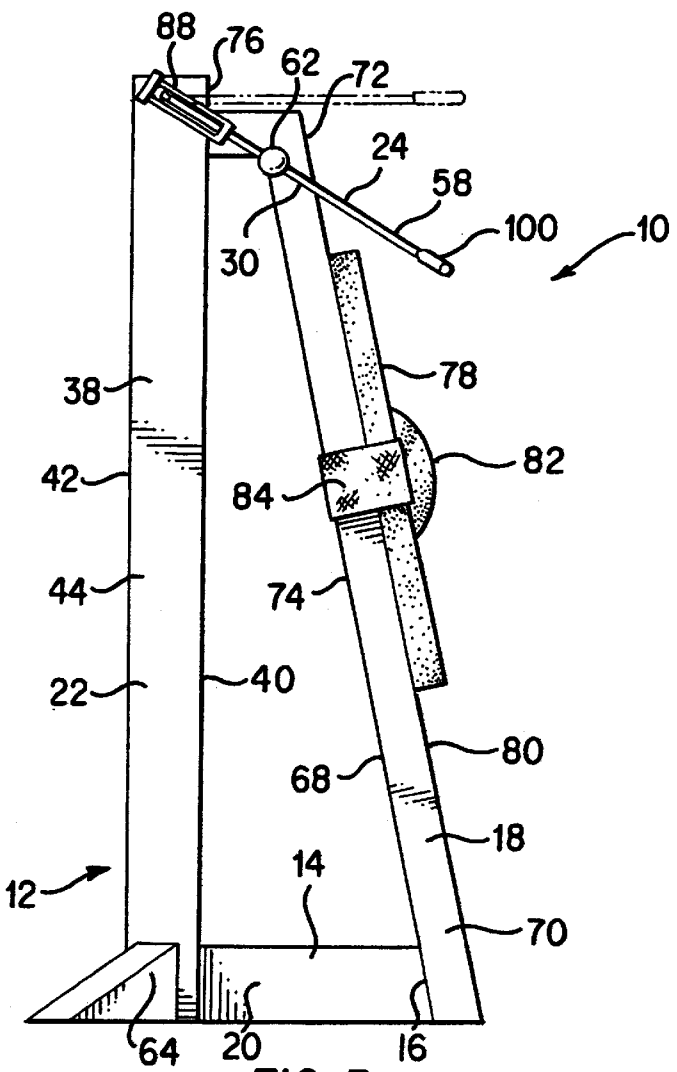
FIG. 3 is a side view of the present exercise apparatus.
Figure 2:
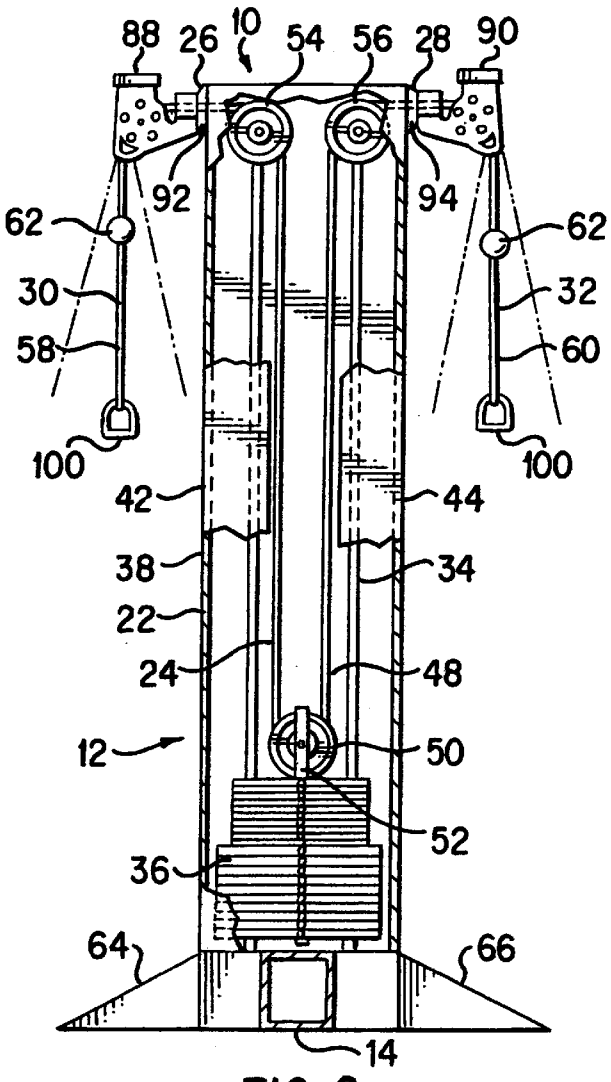
FIG. 2 is a partial cross sectional view of the present exercise apparatus showing the internal structure of the weight stack.

In use, an individual leans against the user support 18 with his or her back facing the weight stack 22. The individual then grips the handles 100 at the distal ends 58, 60 of the respective strands 30, 32 of the cable 24, and pulls the handles 100 away from the weight stack 22 by rotating his or her upper body at the hips to generate resistance from the weight stack 22. As shown in FIGS. 2 and 3, the flexibility provided by the pivoting pulleys permits the individual to move in a wide variety of paths to equally exercise a wide variety of abdominal muscles.

While it is disclosed above that the present abdominal exercise apparatus is designed to be used with the user leaning against the user support and facing away from the weight stack, the versatility provided by the design of the exercise apparatus provides users with virtually unlimited possibilities with regard to the range of exercise motions that may be accommodated by the present exercise apparatus.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. An exercise apparatus, comprising:

a base structure including a central support member having a first end and a second end to which a vertically oriented resistance assembly including a weight stack is secured;

a cable including a first strand and a second strand, the cable links a user to the resistance assembly for the application of resistance as the user moves through an exercise routine, wherein the first and second strands exit the resistance assembly at a position adjacent an upper end of the resistance assembly, the ends of the first and second strands each having a handle for engagement by the user at a position above the shoulders of the user;

a user support structure including an upwardly extending support post, the support post includes a first end secured to the central support member and a second end, the support post further includes a rearward side facing away from the weight stack and has a central section upon which is mounted a user support pad, the central section being angled toward the resistance assembly at an angle to promote a standing user's comfort, said user support pad being shaped, dimensioned and located for supporting a standing user's back as the user stands facing away from the resistance assembly during an exercise routine;

wherein a first pivotally mounted pulley guides the first strand as it exits the resistance assembly and a second pivotally mounted pulley guides the second strand as it exits the resistance assembly, said pulleys being mounted on opposite sides of the resistance assembly.

2. The exercise apparatus according to claim 1, wherein the central support member is a tubular member permitting the passage of cables therethrough to facilitate the adaptation of the base structure for targeting various body parts.

3. The exercise apparatus according to claim 1, wherein the weight stack includes vertical support members aligning and supporting a stack of weight plates to be moved via a pulley system.

4. The family exercise apparatus according to claim 1, wherein the weight stack is actuated via a single cable.

5. The exercise apparatus according to claim 4, wherein a central portion of the cable is passed through a first pulley directly coupled to a stack of weight plates and opposite strands of the cable pass over upper pulleys before being positioned for engagement by the user.

6. The exercise apparatus according to claim 1, wherein the weight stack is vertically oriented and includes a plurality of weight plates coupled to the cable for applying resistance as a user moves through an exercise routine.

7. The exercise apparatus according to claim 1, wherein the resistance assembly includes a housing having a front face, a rear face, a left side and a right side, and the first and second strands respectively exit the resistance assembly from the left and right sides of the resistance assembly before being directed to a user facing away from the rear face of the resistance assembly.

8. The exercise apparatus according to claim 1, wherein the user support pad includes a vertically adjustable lumbar support pad.

9. The exercise apparatus according to claim 1, wherein the central section of the support post is oriented at an angle of 10 degrees.

10. The exercise apparatus according to claim 1, wherein the second end of the support post is secured to the resistance assembly.

* * * * *

UNITED STATES PATENT AND TRADEMARK OFFICE

CERTIFICATE OF CORRECTION

PATENT NO. : 6,422,980 B1
DATED : August 30, 2002
INVENTOR(S) : Roy Simonson

It is certified that error appears in the above-identified patent and that said Letters Patent is hereby corrected as shown below:

Column 6,
Line 55, delete "family"

Signed and Sealed this

Fourteenth Day of January, 2003

JAMES E. ROGAN
*Director of the United States Patent and Trademark Office*